US012359661B2

(12) United States Patent
Bebon et al.

(10) Patent No.: US 12,359,661 B2
(45) Date of Patent: Jul. 15, 2025

(54) METHOD OF CONTROLLING AN AIR COMPRESSOR OF A VEHICLE

(71) Applicant: Volvo Truck Corporation, Gothenburg (SE)

(72) Inventors: Hugo Bebon, Saint-Priest (FR); Pierig Gaillaud, Lyons (FR)

(73) Assignee: Volvo Truck Corporation, Gothenburg (SE)

( * ) Notice: Subject to any disclaimer, the term of this patent is extended or adjusted under 35 U.S.C. 154(b) by 315 days.

(21) Appl. No.: 18/305,417

(22) Filed: Apr. 24, 2023

(65) Prior Publication Data

US 2023/0356699 A1 Nov. 9, 2023

(30) Foreign Application Priority Data

May 6, 2022 (EP) ..... 22172045

(51) Int. Cl.

| | |
|---|---|
| ***B60S 5/00*** | (2006.01) |
| ***F04B 35/04*** | (2006.01) |
| ***F04B 39/16*** | (2006.01) |
| ***F04B 49/02*** | (2006.01) |
| ***F04B 49/06*** | (2006.01) |

(52) U.S. Cl.

CPC ..... *F04B 49/02* (2013.01); *F04B 35/04* (2013.01); *F04B 39/16* (2013.01); *F04B 49/065* (2013.01); *F04B 2205/50* (2013.01)

(58) Field of Classification Search

CPC ..... B01D 53/261; B01D 2257/80; B01D 2258/06; B01D 2259/40003; B01D 2259/4566; B01D 53/0407; B01D 53/0446; B01D 53/047; B01D 53/26

See application file for complete search history.

(56) References Cited

U.S. PATENT DOCUMENTS 4,431,390 A * 2/1984 Hart ..... F04C 29/021 418/84
5,257,008 A * 10/1993 Elamin ..... B60T 17/004 340/602

(Continued)

FOREIGN PATENT DOCUMENTS

EP 2641648 A2 9/2013
JP 2008020113 A * 1/2008

(Continued)

OTHER PUBLICATIONS

Extended European Search Report for European Patent Application No. 22172045.1, mailed Oct. 4, 2022, 9 pages.

*Primary Examiner* — Dominick L Plakkoottam
(74) *Attorney, Agent, or Firm* — Withrow & Terranova, PLLC

(57) ABSTRACT

A method of controlling an air compressor of a vehicle. The absolute humidity is determined for atmospheric air entering the compressor as well as for the compressed air exiting the compressor. A liquid water mass formed or evaporated inside the compressor during a defined period of time is calculated. The above steps are repeated in order to calculate a cumulated liquid water mass inside the compressor. The compressor is stopped when the calculated cumulated liquid water mass has returned to zero and the control unit no longer receives a compressed air request.

17 Claims, 6 Drawing Sheets

(56) References Cited

U.S. PATENT DOCUMENTS

| | | | | | |
|---|---|---|---|---|---|
| RE39,092 | E * | 5/2006 | Horii | F02C 7/1435 60/39.53 |
| 7,832,210 | B2 * | 11/2010 | Fecamp | F23R 3/40 60/777 |
| 8,849,604 | B2 * | 9/2014 | Rowe, Jr. | F25B 13/00 702/181 |
| 10,563,885 | B2 * | 2/2020 | Ha | F24F 3/1405 |
| 11,519,411 | B2 * | 12/2022 | Feiler | G01N 11/04 |
| 2001/0022078 | A1 * | 9/2001 | Horii | F02C 7/1435 60/39.182 |
| 2006/0218938 | A1 | 10/2006 | Fornof | |
| 2006/0220472 | A1 * | 10/2006 | Fecamp | F23R 3/40 307/153 |
| 2011/0278804 | A1 * | 11/2011 | Folchert | B01D 53/261 280/5.503 |
| 2016/0245273 | A1 * | 8/2016 | Wagner | F04B 49/007 |
| 2018/0017062 | A1 | 1/2018 | Peters et al. | |
| 2018/0283248 | A1 * | 10/2018 | Upadhyay | F02D 41/1446 |
| 2019/0136843 | A1 | 5/2019 | Kawai et al. | |
| 2020/0158112 | A1 | 5/2020 | Feiler | |
| 2020/0182206 | A1 * | 6/2020 | Oh | F02M 26/33 |
| 2023/0006221 | A1 * | 1/2023 | Iwai | H01M 8/0432 |

FOREIGN PATENT DOCUMENTS

| | | | | |
|---|---|---|---|---|
| JP | 2012127247 A * | 7/2012 | | |
| JP | 2016089667 A * | 5/2016 | | F02B 29/0406 |
| WO | WO-2012067215 A2 * | 5/2012 | | B01D 53/0407 |

* cited by examiner

Compressed air temperature
Cumulated liquid water mass, Tdpress_max
Cumulated liquid water mass, Tdpress_100

METHOD OF CONTROLLING AN AIR COMPRESSOR OF A VEHICLE

RELATED APPLICATIONS

The present application claims priority to European Patent Application No. 22172045.1, filed on May 6, 2022, and entitled "METHOD OF CONTROLLING AN AIR COMPRESSOR OF A VEHICLE," which is incorporated herein by reference in its entirety.

TECHNICAL FIELD

The present disclosure relates to a method for controlling an air compressor of a vehicle. The present disclosure also relates to a computer program, a computer readable medium and to a control unit.

The teachings of the present disclosure can be applied in heavy-duty vehicles, such as trucks, buses, construction equipment, trains and trams. Although the disclosure will mainly be described with respect to a heavy-duty vehicle, the general inventive concept is not restricted to this particular vehicle, but may also be used in other vehicles such as cars.

BACKGROUND

Compressors are well known in vehicles and are installed for providing compressed air to various parts of the vehicles, such as to service brakes, parking brakes, air suspensions, trailers and pneumatic auxiliaries. Compressors suck atmospheric (ambient) air and increase the pressure of the air. Atmospheric air contains water vapour. The vapour contained in the atmospheric air is converted into liquid water (condensation) inside the compressor if the compressed air temperature (temperature of the air after compression) is below the so-called pressure dew point (Tdpres), i.e., air dew point temperature after compression. When the compressed air temperature becomes strictly higher than Tdpres, liquid water (which was formed when compressed air temperature was below Tdpres) is vaporized and can be released from the compressor as vapour in air flow.

Some compressors are oil lubricated. Oil is used for lubrication, sealing and dissipation of the heat due to the compression process. If the compressor duty cycle is too low, the compressor will not have time to heat and the compressed air temperature will stay below Tdpres. Vapour condenses and is converted into liquid water that stays in the compressor. Liquid water accumulation inside the compressor can lead to corrosion of internal parts and compressor failure. In case of oil lubricated compressors, the liquid accumulation may lead to oil degradation.

In view of the above, it would thus be desirable to avoid liquid water accumulation inside the compressor. A control strategy could be to run the compressor for a predetermined time period in order to increase the chances of the compressed air temperature reaching and staying above Tdpres so that accumulated liquid inside the compressor is vaporized. However, such a control strategy has the disadvantage that if the predetermined time period is too short, then condensed liquid will remain inside the compressor, and if the predetermined time period is too long, then too much energy will be wasted. Thus, there is a need for a control strategy which counteracts liquid accumulation inside the compressor in an energy efficient manner.

SUMMARY

An object of the present disclosure is to provide a method which at least partly alleviates the drawbacks discussed above. This and other objects, which will become apparent in the following discussion, are achieved by a method as defined in the accompanying independent claim. Some non-limiting exemplary embodiments are presented in the dependent claims.

The general inventive concept is based on the realization that by monitoring the absolute humidity of the atmospheric (ambient) air entering the compressor as well as the absolute humidity of the compressed air exiting the compressor, it is possible to calculate a liquid water mass formed or evaporated inside the compressor, and to calculate how such formation or evaporation affects the cumulated liquid water mass inside the compressor. Hereby, it is possible to determine when the cumulated liquid water mass has returned to zero, and at that time allowing the compressor to be stopped (unless the compressor is still needed in case of compressed air request from the vehicle, in which case the compressor may continue to run). Thus, by monitoring the development of the cumulated liquid water mass, it is possible to stop the compressor in a timely manner without unnecessary energy consumption. In other words, the compressor may run for a long enough time to evaporate the cumulated liquid water mass inside the compressor, and a short enough time to avoid wasting energy.

According to a first aspect of the present disclosure, there is provided a method of controlling an air compressor of a vehicle, comprising:

- starting the compressor,
- at the time of starting the compressor:
  - determining, for the atmospheric air entering the compressor, a value $H_{abs,atm}$ of the absolute humidity,
  - determining, for the compressed air exiting the compressor, a value $H_{abs,comp}$ of the absolute humidity,
- based on the determined values $H_{abs,atm}$ and $H_{abs,comp}$, calculating by means of a control unit a liquid water mass formed or evaporated inside the compressor during a defined period of time,
- repeatedly performing the determining steps and the calculating step,
- for each repetition, calculating by means of the control unit a cumulated liquid water mass inside the compressor, and
- stopping the compressor when the calculated cumulated liquid water mass has returned to zero and the control unit no longer receives a compressed air request.

By repeatedly calculating the liquid water mass inside the compressor, it will be possible to determine that the cumulated liquid water mass has returned to zero, i.e., that water formed in the compressor has evaporated. Thus, if there is no demand from other parts of the vehicle for the compressor to provide compressed air, the compressor may be stopped when the zero liquid water mass has been acknowledged. In this way the compressor does not need to run longer than necessary for achieving the evaporation, while still making sure that the compressor has run long enough for the evaporation to have occurred. Of course, it should be understood that if other parts of the vehicle are still in need of compressed air from the compressor, and therefore the control unit still receives such compressed air request, the compressor will not be stopped even though the cumulated liquid water mass is zero.

The compressor will oftentimes be started after the control unit receives a compressed air request, however, as will be explained below, in certain situations the compressor may be started without the control unit receiving a compressed air request. This may be the case, for example, when the vehicle has been turned off and parked before all condensed water has been evaporated from the compressor. In such case, next time the vehicle is started, the control unit will know that there remains cumulated liquid water mass inside the compressor, and may restart the compressor in order to evaporate the cumulated liquid water mass. In other instance, the case may be that the ambient temperature is at such level that the Tdpres cannot be reached. In such case, the control unit may turn off the compressor as soon as no compressed air request is received, and when temperature conditions are such that Tdpres can be reached, the control unit may restart the compressor to evaporate the condensed liquid water inside the compressor.

The method according to the present disclosure may suitably be a computer-implemented method. Suitably, the implementation may be embodied in a control unit, such as the above-discussed control unit.

The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where it includes a programmable device such as the microprocessor, microcontroller or programmable digital signal processor mentioned above, the processor may further include computer executable code that controls operation of the programmable device.

According to at least one exemplary embodiment, said formation or evaporation of liquid water mass is calculated for a series of consecutive periods of time, wherein the start of a next period of time in said series coincides with the end of the previous period of time in said series, wherein the cumulated liquid water mass inside the compressor is calculated by summarizing the calculation for said series of consecutive periods of time.

By doing the calculations "back-to-back" for consecutive periods of time, no formation or evaporation of liquid is overlooked, nor is any formation or evaporation calculated twice. As a consequence, a high accuracy is attainable for the repeated calculation of the cumulated liquid water mass.

According to at least one exemplary embodiment, the method comprises storing the most recently calculated value of the cumulated liquid water mass in an electronic memory. This is advantageous as it not only allows facilitates updating when the compressor is running and new calculations are made, but also in case the cumulated liquid has not been evaporated since the last time the compressor was stopped, for whichever reason. An example of such a reason will be discussed below. The electronic memory may suitably be accessible by the control unit, either in the form of an internal memory in the control unit or an external memory with which the control unit can communicate by wire or wirelessly.

According to at least one exemplary embodiment, the method comprises, when the vehicle is turned on after having been turned off:

restarting the compressor, repeatedly performing the determining steps and the calculating steps, for each repetition, calculating the cumulated liquid water mass inside the compressor and updating the stored value in the electronic memory with a new calculated value of the cumulated liquid water mass, and stopping the compressor when the new calculated value of the cumulated liquid water mass is zero.

Thus, by having stored in the electronic memory the cumulated liquid water mass until the vehicle was turned off, the calculations and updating may continue when the vehicle is turned on again and the compressor is restarted.

Similarly to the previous example of restarting the compressor when the vehicle has been turned off, in at least some other exemplary embodiments, the method comprises, when the compressor has been stopped before the cumulated liquid water mass has returned to zero:

restarting the compressor, repeatedly performing the determining steps and the calculating steps, for each repetition, calculating the cumulated liquid water mass inside the compressor and updating the stored value in the electronic memory with a new calculated value of the cumulated liquid water mass, and stopping the compressor when the new calculated value of the cumulated liquid water mass is zero.

This exemplary embodiment reflects a situation in which the control unit may determine that the compressor will, under the present conditions, not be able to evaporate the condensed liquid water inside the compressor, and therefore stops the compressor when there is no compressed air request from other parts of the vehicle. Hereby, it can be avoided that the cumulated liquid water mass keeps increasing even when there is no compressed air request. When the control unit determined that the conditions are again favourable for evaporation, the control unit may once again start the compressor and calculate the change in cumulated liquid water mass in accordance with the above-described control strategy.

According to at least one exemplary embodiment, said step of calculating a liquid water mass formed or evaporated inside the compressor for a defined period of time comprises determining the flow rate through the compressor for said defined period of time, wherein the formed or evaporated liquid water mass is calculated based on the determined flow rate during the defined period of time. For instance, in a simplified case, if the values $H_{abs,atm}$ and $H_{abs,comp}$ are constant and the flow rate Q is constant, then the liquid water mass during a time t, can simply be calculated as:

$$\text{Liquid water mass}=(H_{abs,atm}-H_{abs,comp})\times Q\times t$$

If the result is positive, this mass is liquid water mass formed.

If the result is negative, this mass is liquid water mass vaporized into vapour.

According to at least one exemplary embodiment, the liquid water mass formed or evaporated in the compressor for said defined period of time is calculated using the formula:

$$M_{t_n} = \left(\frac{H_{abs,atm_{t_{n-1}}} + H_{abs,atm_{t_n}}}{2} - \frac{H_{abs,comp_{t_{n-1}}} + H_{abs,comp_{t_n}}}{2}\right)\times\frac{Q_{t_{n-1}} + Q_{t_n}}{2}\times p$$

where $M_{t_n}$ is the liquid water mass formed or evaporated from time $t_{n-1}$ to time $t_n$, where a positive number represents formation and a negative number represents evaporation, n is a natural number, $t_n = t_{n-1} + p$, p is a time step, strictly positive and any real number, $$H_{abs,atm_{t_{n-1}}}$$

is the value of the absolute humidity for atmospheric air determined at time $t_{n-1}$, $$H_{abs,atm_{t_n}}$$

is the value of the absolute humidity for atmospheric air determined at time $t_n$, $$H_{abs,comp_{t_{n-1}}}$$

is the value of the absolute humidity for compressed air determined at time $t_{n-1}$, considering 100% relative humidity for compressed air, $$H_{abs,comp_{t_n}}$$

is the value of the absolute humidity for compressed air determined at time $t_n$, considering 100% relative humidity for compressed air, $Q_{t_{n-1}}$ is the flow rate through the compressor determined at time $t_{n-1}$, $Q_{t_n}$ is the flow rate through the compressor determined at time $t_n$.

The calculations may suitably be made by the control unit.

According to at least one exemplary embodiment, the cumulated liquid water mass at time $t_n$ is calculated using the formula:

$$M_{c,t_n} = M_{c,t_{n-1}} + M_{t_n}$$

Where $M_{c,t_n}$ is the cumulated liquid water mass at time $t_n$, $M_{c,t_{n-1}}$ is the cumulated liquid water mass at time $t_{n-1}$.

The calculations may suitably be made by the control unit.

According to at least one exemplary embodiment, the step of determining the flow rate comprises measuring the compressor speed and determining the flow rate based on the measured compressor speed. This is a convenient way to determine the flow rate as the compressor speed is generally easily acquired and known from the compressor itself (a compressor ECU may generally be sending its actual speed via a CAN bus).

According to at least one exemplary embodiment, said step of determining the value $H_{abs,atm}$ of the absolute humidity for the atmospheric air entering the compressor, comprises:

- measuring the relative humidity of the atmospheric air with a humidity sensor,
- measuring the temperature of the atmospheric air with a first temperature sensor, and
- determining said value $H_{abs,atm}$ based on the measured relative humidity and measured temperature of the atmospheric air.

Additionally, the determination of the value $H_{abs,atm}$ may suitably also be based on the atmospheric pressure.

In at least some exemplary embodiments, instead of using a humidity sensor, an alternative is to estimate the relative humidity. For instance, the relative humidity may instead be estimated. In other exemplary embodiments, instead of making an estimation, the relative humidity may simply be determined to be 100%, thereby applying a worst-case scenario for determining the absolute humidity for the atmospheric air.

According to at least one exemplary embodiment, said steps of determining the value $H_{abs,atm}$ further comprises:

- determining the vehicle's current altitude over sea level by means of a navigation system,
- determining the atmospheric air pressure based on the determined altitude,
- determining said value $H_{abs,comp}$ based on the determined atmospheric air pressure.

This provides a simple way to estimate that atmospheric pressure for determining the value $H_{abs,atm}$. However, as indicated previously, an alternative is to use a pressure sensor, and another alternative is to use 1.013 bar as the value of the atmospheric air pressure when determining the value $H_{abs,atm}$ of the absolute humidity for the atmospheric air.

According to at least one exemplary embodiment, said step of determining the value $H_{abs,comp}$ of the absolute humidity for the compressed air exiting the compressor, comprises

- measuring the temperature of the atmospheric air with a first temperature sensor,
- determining the atmospheric pressure, such as by measuring the pressure of the atmospheric air with a first pressure sensor or estimating the pressure from the vehicle altitude or estimating the pressure to be 1.013 bar,
- determining the pressure of the compressed air, such as by measuring the pressure of the compressed air with a second pressure sensor or fixed parameter depending on system pressure,
- measuring the relative humidity of the atmospheric air with a humidity sensor,
- measuring the temperature of the compressed air with a second temperature sensor, and
- determining said value $H_{abs,comp}$ based on the measured temperature of the atmospheric air, the determined atmospheric pressure, the determined pressure of the compressed air, the measured relative humidity and measured temperature of the compressed air.

According to at least one exemplary embodiment, the second temperature sensor is placed in the coldest area of the compressor. This is advantageous since the coldest area presents the highest risk of condensation. However, if it is not practically possibly to place the second temperature sensor in the coldest area of the compressor, for example because of limitations due to the design of the compressor, a delta temperature $\Delta T$ may be taken between the measured temperature with the second sensor and the temperature used for calculation so that the coldest area is covered in the calculations.

So, $T_{calculation} = T_{measured} - \Delta T$. The selected value of $\Delta T$ depends on the actual location of the second temperature sensor and should be defined to cover the coldest area of the compressor.

According to at least one exemplary embodiment, the method comprises:

using a compressor map to select, by means of the control unit, a compressor speed for which the temperature increase gradient relative to electric power consumption is optimized, and operating the compressor at said selected compressor speed.

This is advantageous as it avoids unnecessary power consumption. Thus, the above exemplified embodiment not only allows the compressor to stop in time, i.e., not running the compressor when no longer needed for evaporating the condense liquid water, but also finds a balance for the actual evaporation process so that the temperature increase is at an energy efficient pace.

According to a second aspect of the present disclosure there is provided a computer program comprising program code means for performing the steps of the method according to the first aspect, including any embodiment thereof. The advantages of the computer program of the second aspect are largely analogous to the advantages of the method of the first aspect, including any embodiment thereof.

According to a third aspect of the present disclosure, there is provided a computer readable medium carrying a computer program comprising program code means for performing the steps of the method according to the first aspect, including any embodiment thereof, when said program product is run on a computer. The advantages of the computer readable medium of the third aspect are largely analogous to the advantages of the method of the first aspect, including any embodiment thereof.

According to a fourth aspect of the present disclosure, there is provided a control unit for controlling an air compressor of a vehicle, the control unit being configured to perform the steps of the method according to the first aspect, including any embodiment thereof. The advantages of the control unit of the fourth aspect are largely analogous to the advantages of the method of the first aspect, including any embodiment thereof.

According to a fifth aspect of the present disclosure, there is provided a system for controlling an air compressor of a vehicle. The system may comprise a control unit and a plurality of sensors that provide sensor input to the control unit. Such as system may be used for performing the method of the first aspect, including any embodiment thereof. The advantages of the system of the fifth aspect are largely analogous to the advantages of the method of the first aspect, including any embodiment thereof.

According to at least one exemplary embodiment, the system may comprise:

a control unit configured to start the compressor, a first sensor configured to determine, for the atmospheric air entering the compressor, a value $H_{abs,atm}$ of the absolute humidity, a second sensor configured to determine, for the compressed air, exiting the compressor, a value $H_{abs,comp}$ of the absolute humidity, wherein the control unit is configured to receive the determined values from the first and second sensors and is configured to, based on the determined values $H_{abs,atm}$ and $H_{abs,comp}$, calculate a liquid water mass formed or evaporated inside the compressor during a defined period of time, wherein the first and second sensors are configured to repeatedly determine said values $H_{abs,atm}$ and $H_{abs,comp}$, and the control unit is configured to repeatedly calculate said formed or evaporated liquid mass, wherein for each repetition, the control unit is configured to calculate a cumulated liquid water mass inside the compressor, and wherein the control unit is configured to stop the compressor when the calculated cumulated liquid water mass has returned to zero and the control unit no longer receives a compressed air request.

Examples of sensors that may be included in the system to provide information to the control unit include temperature sensors, humidity sensors, pressure sensors, flow sensors, etc.

Generally, all terms used in the claims are to be interpreted according to their ordinary meaning in the technical field, unless explicitly defined otherwise herein. All references to "a/an/the part, element, apparatus, component, arrangement, device, means, step, etc." are to be interpreted openly as referring to at least one instance of the part, element, apparatus, component, arrangement, device, means, step, etc., unless explicitly stated otherwise. The steps of any method disclosed herein do not have to be performed in the exact order disclosed, unless explicitly stated. Further features of, and advantages with, the present inventive concept will become apparent when studying the appended claims and the following description. The skilled person realizes that different features of the present inventive concept may be combined to create embodiments other than those described in the following, without departing from the scope of the present inventive concept.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
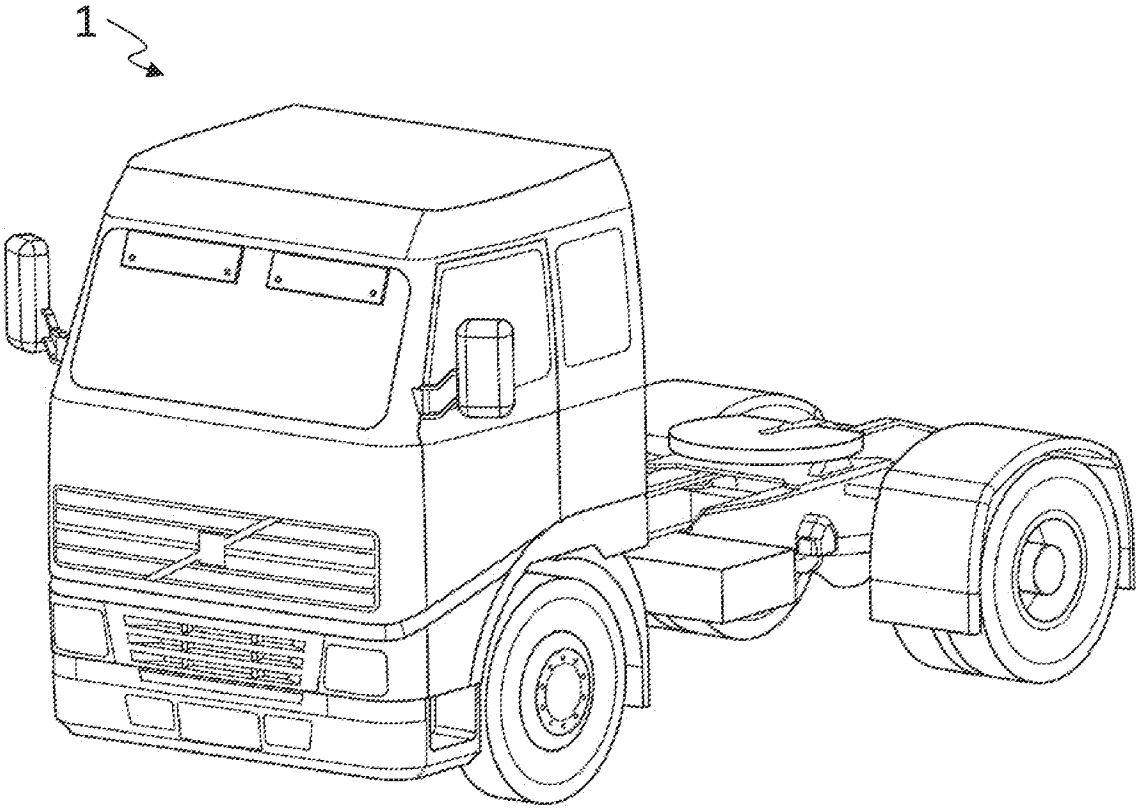
FIG. 1 illustrates a vehicle according to at least one exemplary embodiment, for which the method of the present disclosure may be implemented.

The invention will now be described more fully hereinafter with reference to the accompanying drawings, in which certain aspects of the invention are shown. The invention may, however, be embodied in many different forms and should not be construed as limited to the embodiments and aspects set forth herein; rather, the embodiments are provided by way of example so that this disclosure will be thorough and complete, and will fully convey the scope of the invention to those skilled in the art. Accordingly, it is to be understood that the present invention is not limited to the embodiments described herein and illustrated in the drawings; rather, the skilled person will recognize that many changes and modifications may be made within the scope of the appended claims. Like reference numerals refer to like elements throughout the description.

FIG. 1 illustrates a vehicle 1 according to at least one exemplary embodiment, for which the method of the present disclosure may be implemented. In this example, the vehicle 1 is a heavy-duty vehicle in the form of a tractor unit. However, the teachings of the present disclosure may also be implemented in other types of vehicles which use an air compressor for providing compressed air to various other parts of the vehicle.

Figure 2:
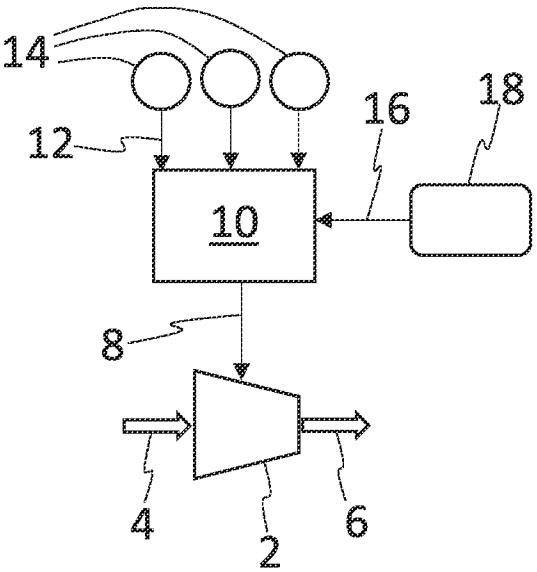
FIG. 2 illustrates schematically an example of components that may be used for carrying out the method of the present disclosure.

FIG. 2 illustrates schematically an example of components that may be used for carrying out the method of the present disclosure. An air compressor 2 is provided for sucking ambient air 4 and to increase the pressure of the air. Compressed air 6 leaves the compressor 2 and may be provided to other parts of the vehicle, such as to a service brake, a parking brake, air suspensions, a connected trailer, auxiliaries, etc. The compressor 2 may be operated in response to control signals 8 from a control unit 10. Thus, the control unit 10 controls the operation of the compressor 2. The control unit 10 can turn the compressor 2 on and off. Furthermore, the control unit 10 can control the rotational speed of the compressor 2. The control unit 10 may be used for implementing the method of this disclosure. As such, the method of the present disclosure may be a computer-implemented method performed by the control unit 10. The control unit 10 may receive various sensor signals 12 from different sensors 14 and may process the sensor signals 12 to determine appropriate controlling of the air compressor 2. Furthermore, the control unit 10 may receive request signals 16 from various other parts or subsystems of the vehicle that demand compressed air to be provided from the compressor 2. In the present illustration a pressurized air tank 18 is illustrated as sending a request signal 16 to the control unit 10. For instance, the tank 18 may act as a storage for pressurized air to be distributed to other components, and when the pressure is low, a request signal 16 may be sent to the control unit 10. However, it is conceivable to allow the control unit 10 to receive request signals 16 from other parts of the vehicle as well. Furthermore, although three sensors 14 are illustrated, it should be understood that this is just made for explanatory purposes, and it should be understood that the specific number of sensors 14 may be varied according to the desired implementation of the method disclosed in here and its various exemplary embodiments. Examples of sensors 14 include temperature sensors, humidity sensors, pressure sensors, flow sensors, etc. Further details of the control unit 10 will be briefly discussed later in connection with FIG. 7.

Figure 3:
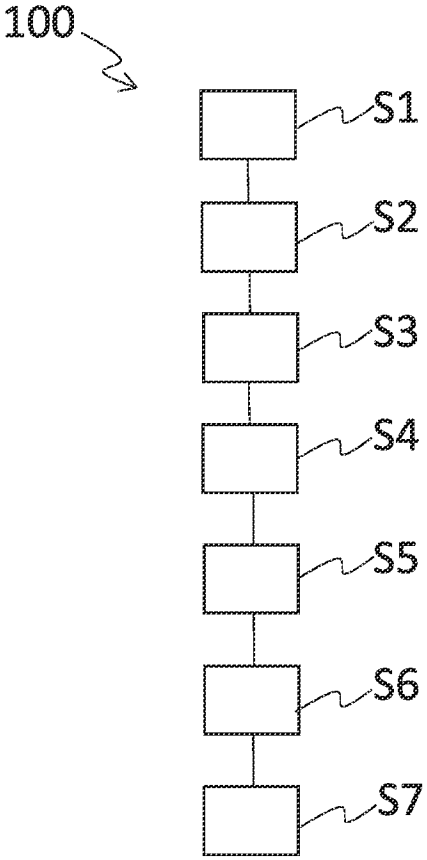
FIG. 3 illustrates schematically a method in accordance with at least one exemplary embodiment of the present disclosure.

FIG. 3 illustrates schematically a method 100 in accordance with at least one exemplary embodiment of the present disclosure. More specifically, FIG. 3 illustrates a method 100 of controlling an air compressor of a vehicle. The method 100 comprises:

in a step S1, starting the compressor, at the time of starting the compressor:

in a step S2, determining, for the atmospheric air entering the compressor, a value $H_{abs,atm}$ of the absolute humidity, in a step S3, determining, for the compressed air exiting the compressor, a value $H_{abs,comp}$ of the absolute humidity, in a step S4, based on the determined values $H_{abs,atm}$ and $H_{abs,comp}$, calculating by means of a control unit a liquid water mass formed or evaporated inside the compressor during a defined period of time, in a step S5, repeatedly performing the determining steps and the calculating step, for each repetition, in a step S6, calculating by means of the control unit a cumulated liquid water mass inside the compressor, and in a step S7, stopping the compressor when the calculated cumulated liquid water mass has returned to zero and the control unit no longer receives a compressed air request.

Step 1 may, for instance, be initiated by a compressed air request from another part of the vehicle. For example, as illustrated in FIG. 2, the compressed air request may come as a request signal 16 from a tank 18. However, Step 1 may also be initiated if the control unit knows that there is condensed liquid in the compressor, i.e., without a compressed air request having been received. For instance, the control unit may access an electronic memory which stored the latest calculated cumulated liquid water mass before the compressor was shut off. The fact that the compressor was shut off before all liquid had evaporated may be because the vehicle was turned off, or it may be because there was no compressed air request and that the conditions were not adequate for enabling the compressed air temperature to exceed the pressure dew point (Tdpres).

Steps 2 and 3, i.e., determining the absolute humidity of the atmospheric air ($H_{abs,atm}$) and the absolute humidity of the compressed air ($H_{abs,comp}$) may be accomplished by using the following general method to calculate absolute humidity $H_{abs}$ [g/m$^3$]:

1/Coefficient $\vartheta$ $$\vartheta = 1 - \frac{T}{T_c} \tag{1}$$

With:

T=air temperature [K]

Tc=critical temperature of water, Tc=647.096 K

A first temperature sensor may be used to measure the temperature of the atmospheric air, for determining/calculating the absolute humidity of the atmospheric air. A second temperature sensor provided inside the compressor may be used to measure a temperature of the compressed air, the for determining/calculating the absolute humidity of the compressed air.

2/ Water Vapour Saturation Pressure Pws [hPa]

$$P_{ws} = P_c \exp\left(\frac{T_C}{T}\left(C_1\vartheta + C_2\vartheta^{1.5} + C_3\vartheta^3 + C_4\vartheta^{3.5} + C_5\vartheta^4 + C_6\vartheta^{7.5}\right)\right) \tag{2}$$

With:

Pc=critical pressure of water, Pc=220640 hPa

C1 to C6=constants known from literature

3/ Water Vapour Partial Pressure Pw [hPa]

$$P_w = \frac{P_{ws} RH}{100\%} \tag{3}$$

RH is the relative humidity of the atmospheric air. This may, for instance, be measured by means of a humidity sensor.

4/ Absolute Humidity $H_{abs}$ [g/m3]

$$H_{abs} = C \cdot \frac{P_w}{T} \tag{4}$$

With C=2.16679 g·K/J

Continuing with the method of FIG. 3, the step S4, i.e., calculating by means of a control unit a liquid water mass formed or evaporated inside the compressor during a defined period of time, may be accomplished by using the below formula, which has already been discussed and explained previously in this disclosure.

$$M_{t_n} = \left(\frac{H_{abs,\,atm_{t_{n-1}}} + H_{abs,\,atm_{t_n}}}{2} - \frac{H_{abs,\,comp_{t_{n-1}}} + H_{abs,\,comp_{t_n}}}{2}\right) \times \frac{Q_{t_{n-1}} + Q_{t_n}}{2} \times p$$

As the compressor is running the above determinations/calculations are repeated (step S5) and the cumulated liquid water mass is calculated in connection with each repetition (step S6). The cumulated liquid water mass may be calculated by using the below formula, which has already been discussed and explained previously in this disclosure.

$$M_{c,t_n} = M_{c,t_{n-1}} + M_{t_n}$$

When the sum of the above formula results in zero, and the control unit (e.g., the control unit in FIG. 2) does not receive a compressed air request, then in accordance with step S7, the control unit may stop the compressor.

Figure 4:
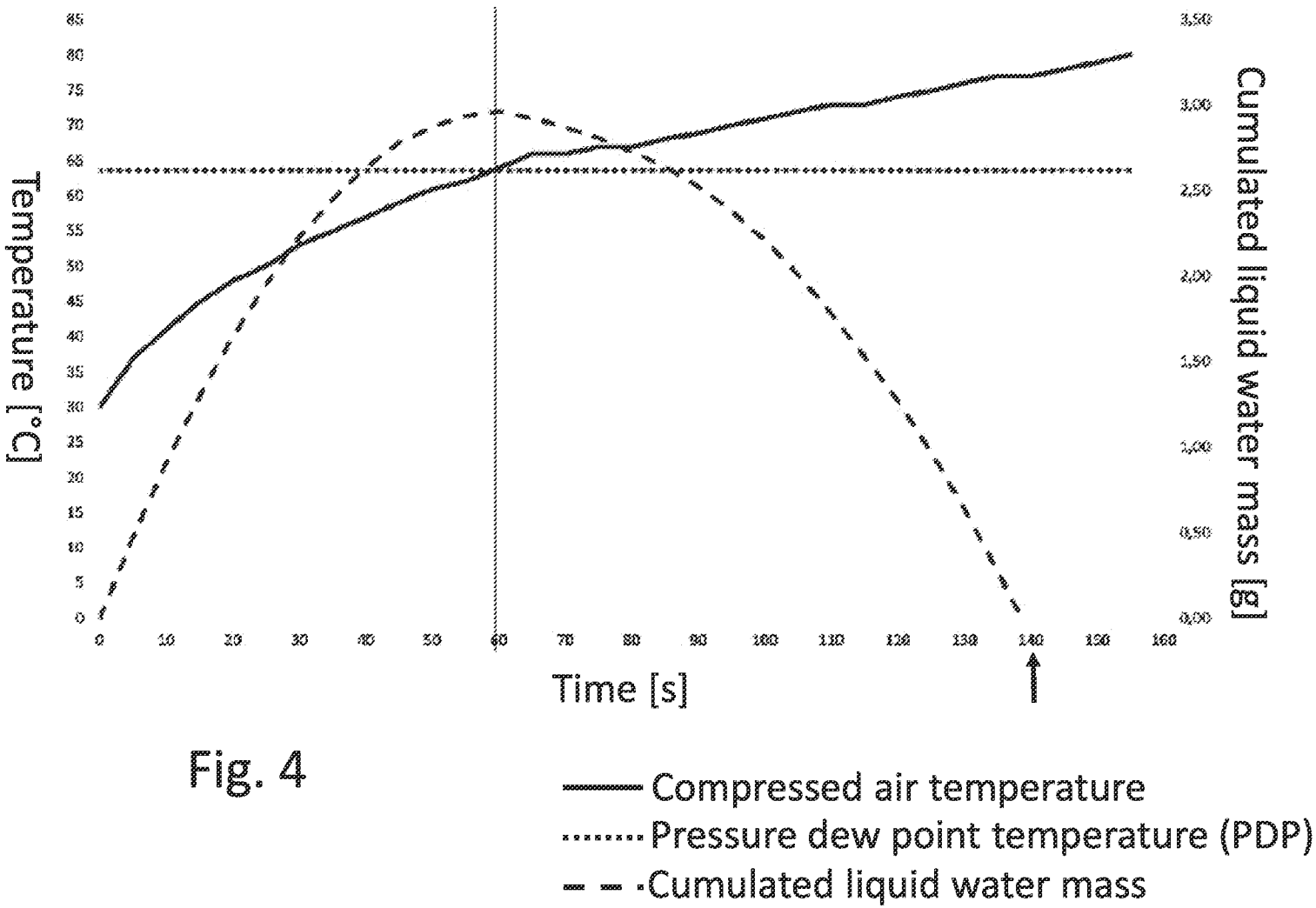
FIG. 4 illustrates schematically a graphical representation of the implementation of at least one exemplary embodiment of the method of the present disclosure.

FIG. 4 illustrates schematically a graphical representation of the implementation of at least one exemplary embodiment of the method of the present disclosure. The solid black line shows how the compressor air temperature increases after the compressor has been started (i.e., at time zero). The dotted line shows the pressure dew point temperature (Tdpres), which in this example is approximately 65° C. After compression, if the compressed air temperature is below Tdpres, air becomes saturated (RH=100%). In other words, as long as the compressed air temperature is below Tdpres, the water vapour in the air condenses into liquid water inside the compressor. However, when the compressed air temperature exceeds Tdpres, then the liquid water inside the compressor is vaporized and can be released from the compressor as vapour in the air flow. In the example in FIG. 4, the solid line representing the compressed air temperature crosses the dotted line representing Tdpres at approximately 60 s. When this happens, the dashed line, representing the cumulated liquid water mass, turns downwardly, i.e., the cumulated liquid water mass is steadily decreased as the liquid water evaporates. As indicated by the arrow, at approximately 140 s, the cumulated liquid water mass has returned to zero. Unless the control unit still receives a compressed air request, it can now stop the compressor. Hereby, the liquid water has been successfully evaporated without running the compressor for longer than necessary, thereby saving energy.

In at least some exemplary embodiments, the control unit may suitably calculate the pressure dew point Tdpres when starting the compressor. This may be based on ambient air temperature, relative humidity, ambient air pressure and compressed air pressure. Furthermore, the control unit may know, or may determine, the maximum temperature, Tmax, that can be reached uniformly and steadily by the air during the compression in the compressor.

If Tmax>Tdepres, then the control unit may control the compressor according to the above control strategy.

However, if Tmax≤Tdepres, then there are two different cases, which will here be referred to as Case 1 and Case 2.

Case 1: Actual relative humidity is known from humidity sensor or other means, (the control strategy of Case 1 can also be used if worst case 100% RH is assumed).

If Tmax≤Tdepres, this means that no matter for how long time the compressor is running, the compressed air temperature will never exceed Tdpres, so there is no possibility to evaporate liquid water and condensation will occur during all the time that the compressor is running. In this case, the control unit may suitably limit the running time of the compressor to what is needed by the vehicle, and avoid any extra time, as Tdpres cannot be passed and condensation is occurring. Thus, the control unit may suitably stop the compressor when the vehicle no longer needs any more compressed air, i.e., no compress air request received. Accordingly, in this Case 1, the control unit stops the compressor even though there is liquid water, simply because not stopping the compressor would increase the accumulation of liquid water.

The control unit may store in an electronic memory the cumulated liquid water mass that was created during this running phase when Tmax≤Tdepres. The liquid water mass may then be eliminated the next time conditions allow to have compressed air temperature greater than the pressure dew point temperature, i.e., when conditions allow Tmax>Tdepres and evaporation can occur. The compressor may be restarted to evaporate liquid water either during vehicle needs or whenever the conditions (such as relative humidity, ambient temperature) are such that Tmax>Tdepres.

Figure 5:
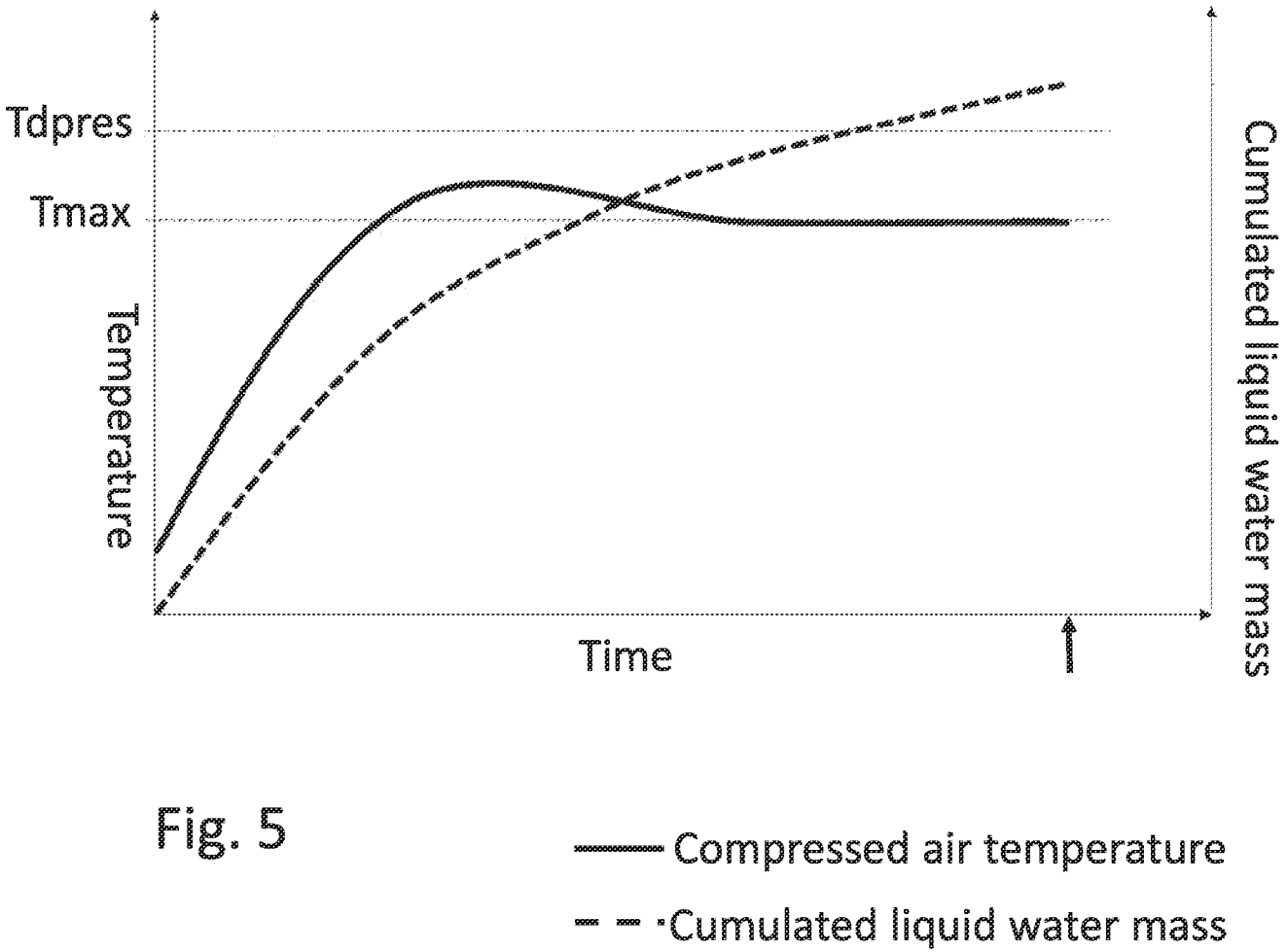
FIG. 5 illustrates schematically another graphical representation.

Case 1 is illustrated in FIG. 5

Case 2: Actual relative humidity is not known, and worst-case scenario is assumed, i.e., 100% RH. In this case the control unit may calculates the pressure dew point for worst case 100% RH, Tdpres_100.

If Tmax<Tdpres_100 this means that no matter for how long time the compressor is running, the air temperature will never reach the dew point Tdpres_100 and therefore there is no possibility to evaporate liquid water inside the compressor and condensation will continue as long as the compressor is running. However, this is the worst-case scenario and since the actual relative humidity (RH) is not known, the actual RH may be lower than 100%.

In this case the control unit may base the anti-condensation function on the max Tdpres that can be reached by the compressor with Tdpres_max=Tmax−ΔT (where ΔT is strictly positive, e.g., 1° C.).

From Tdpres_max and the below equations and the above equations [(7)→(6)→(1)→(2)→(3)], the control unit can calculate the RH corresponding to Tdpres_max and base the ant-condensation function on this RHmax.

1/ Compressed Air Absolute Pressure Ppres [hPa]

$$P_{pres} = P_{amb} + P_{rel_pres} \tag{5}$$

2/ Water Vapour Partial Pressure of Compressed Air Pwpres [hPa]

$$P_{wpres} = \frac{P_{pres}}{P_{amb}} P_w \tag{6}$$

3/ Pressure Dew Point Tdpres [° C.]

$$T_{dpres} = \frac{T_n}{\frac{m}{\log\left(\frac{P_{wpres}}{A}\right)} - 1} \tag{7}$$

where A, m and $T_n$ are constants for calculating the dew point temperature over different temperature ranges and are listed in commercially available lookup tables.

The control unit stops the compressor when the cumulated liquid water mass (Tdepress_max; RHmax)=0 g. This allows to cover and avoid condensation in cases where the actual RH≤RHmax and actual Tdpres≤Tdpres_max.

In parallel, the control unit may calculate and keep in memory the cumulated liquid water mass (Tdpres_100; 100% RH) as well as RHmax and the date and time that this occurs. The cumulated liquid water mass (Tdpres_100; 100% RH) is incremented each time Tmax<Tdpres_100, and if it reaches a defined maximum value, the control unit can warn the driver/user with a message. The driver/user can check actual RH and reset the cumulated liquid water mass (Tdpres_100; 100% RH) if actual RH<Hmax, or drain and exchange compressor oil if actual RH>RHmax.

Figure 6:
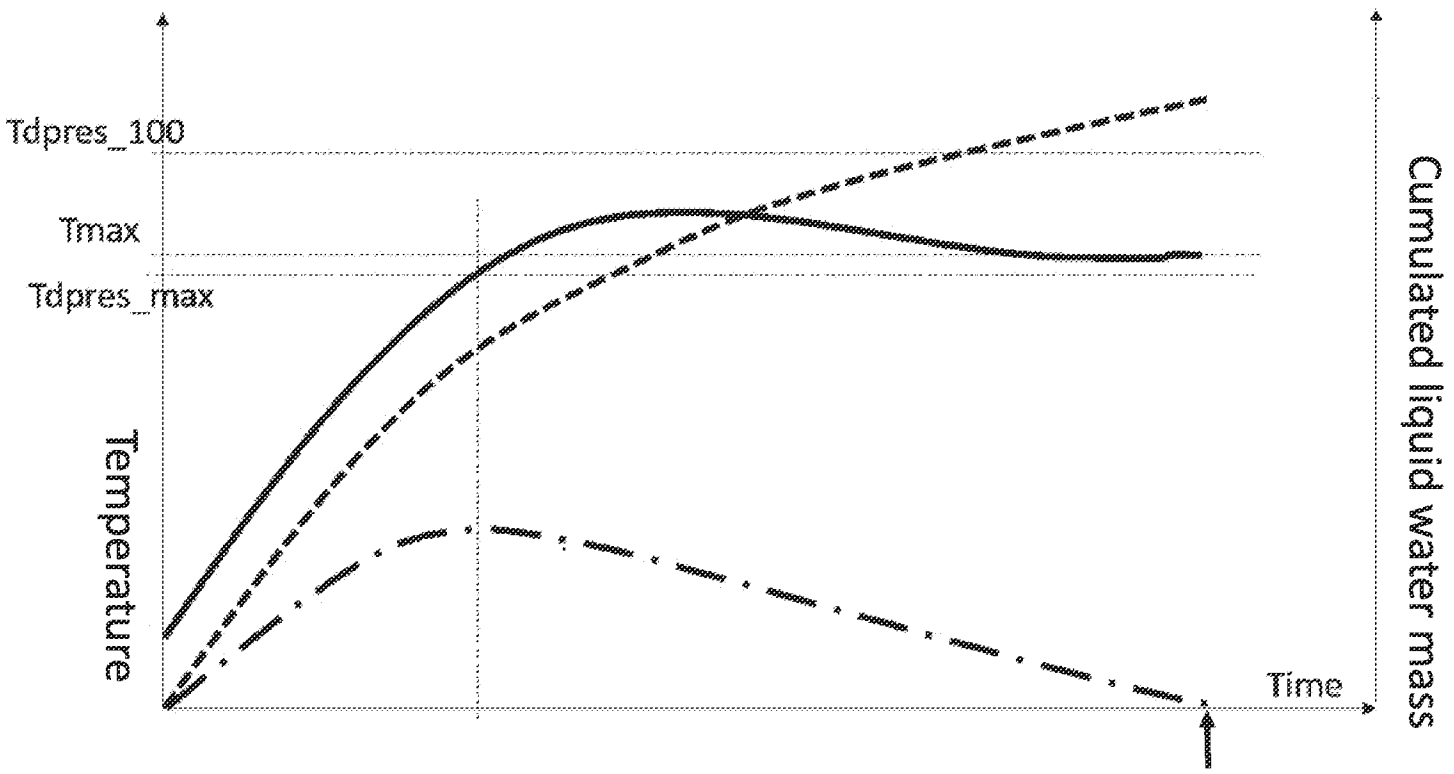
FIG. 6 illustrates schematically yet another graphical representation.

Case 2 is illustrated in FIG. 6.

Figure 7:
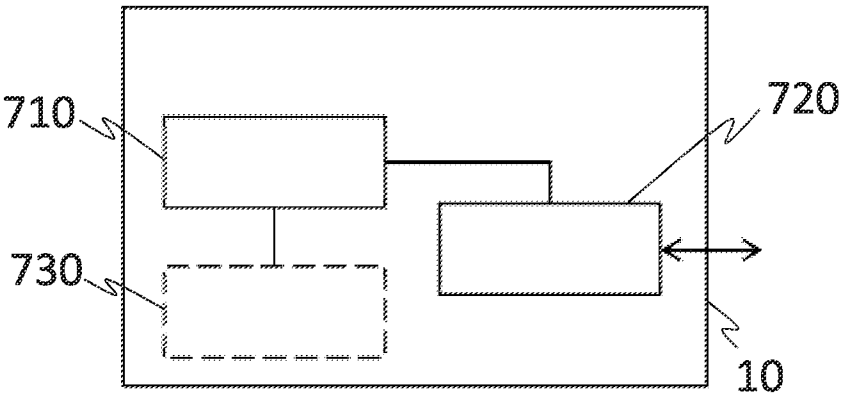
FIG. 7 illustrates schematically a control unit according to at least one exemplary embodiment of the present disclosure.

FIG. 7 schematically illustrates a control unit 10 according to at least one exemplary embodiment of the present disclosure. In particular, FIG. 7 illustrates, in terms of a number of functional units, the components of a control unit 10 according to exemplary embodiments of the discussions herein. The control unit 10 may be comprised in any vehicle disclosed herein, such as the one illustrated in FIG. 1, and others discussed above. Processing circuitry 710 may be provided using any combination of one or more of a suitable central processing unit CPU, multiprocessor, microcontroller, digital signal processor DSP, etc., capable of executing software instructions stored in a computer program product, e.g., in the form of a storage medium 730. The processing circuitry 710 may further be provided as at least one application specific integrated circuit ASIC, or field programmable gate array FPGA.

Particularly, the processing circuitry 710 is configured to cause the control unit 10 to perform a set of operations, or steps, such as the method discussed in connection to FIG. 3, and exemplary embodiments thereof discussed throughout this disclosure. For example, the storage medium 730 may store the set of operations, and the processing circuitry 710 may be configured to retrieve the set of operations from the storage medium 730 to cause the control unit 10 to perform the set of operations. The set of operations may be provided as a set of executable instructions. Thus, the processing circuitry 710 is thereby arranged to execute exemplary methods as herein disclosed.

The storage medium 730 may also comprise persistent storage, which, for example may be any single one or combination of magnetic memory, optical memory, solid state memory or even remotely mounted memory.

The control unit 10 may further comprise an interface 720 for communications with at least one external device such as the compressor 2, the sensors 14 and the tank 18 discussed herein. As such, the interface 720 may comprise one or more transmitters and receivers, comprising analogue and digital components and a suitable number of ports for wireline or wireless communication.

The processing circuitry 710 controls the general operation of the control unit 10, e.g., by sending data and control signals to the interface 720 and the storage medium 730, by receiving data and reports from the interface 720, and by retrieving data and instructions form the storage medium 730. Other components, as well as the related functionality, of the control unit 10 are omitted in order not to obscure the concepts presented herein.

Figure 8:
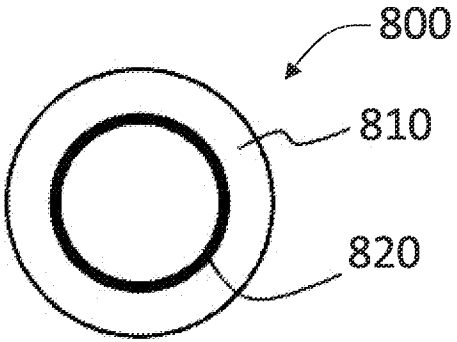
FIG. 8 illustrates schematically a computer program product according to at least one exemplary embodiment of the present disclosure.

FIG. 8 schematically illustrates a computer program product 800 according to at least one exemplary embodiment of the present disclosure. More specifically, FIG. 8 illustrates a computer readable medium 810 carrying a computer program comprising program code means 820 for performing the methods exemplified in FIG. 3, when said program product is run on a computer. The computer readable medium 810 and the program code means 820 may together form the computer program product 800.

The invention claimed is:

1. A method of controlling an air compressor of a vehicle, comprising:

starting the compressor, at the time of starting the compressor:

determining, for the atmospheric air entering the compressor, a value $H_{abs,atm}$ of the absolute humidity, and determining, for the compressed air exiting the compressor, a value $H_{abs,comp}$ of the absolute humidity, based on the determined values $H_{abs,atm}$ and $H_{abs,comp}$, calculating by means of a control unit a liquid water mass formed or evaporated inside the compressor during a defined period of time, repeatedly performing the determining steps and the calculating step, for each repetition, calculating by means of the control unit a cumulated liquid water mass inside the compressor, and stopping the compressor when the calculated cumulated liquid water mass has returned to zero and the control unit no longer receives a compressed air request.

2. The method of claim 1, wherein the formation or evaporation of liquid water mass is calculated for a series of consecutive periods of time, wherein the start of a next period of time in the series coincides with the end of the previous period of time in the series, wherein the cumulated liquid water mass inside the compressor is calculated by summarizing the calculation for the series of consecutive periods of time.

3. The method of claim 1, comprising storing the most recently calculated value of the cumulated liquid water mass in an electronic memory.

4. The method of claim 3, further comprising, when the vehicle is turned on after having been turned off:

restarting the compressor, repeatedly performing the determining steps and the calculating steps, for each repetition, calculating the cumulated liquid water mass inside the compressor and updating the stored value in the electronic memory with a new calculated value of the cumulated liquid water mass, and stopping the compressor when the new calculated value of the cumulated liquid water mass is zero.

5. The method of claim 1, wherein the step of calculating the liquid water mass formed or evaporated inside the compressor for a defined period of time comprises determining the flow rate through the compressor for the defined period of time, wherein the formed or evaporated liquid water mass is calculated based on the determined flow rate during the defined period of time.

6. The method of claim 5, wherein the liquid water mass formed or evaporated in the compressor for the defined period of time is calculated using the formula:

$$M_{t_n} = \left(\frac{H_{abs,atm_{t_{n-1}}} + H_{abs,atm_{t_n}}}{2} - \frac{H_{abs,comp_{t_{n-1}}} + H_{abs,comp_{t_n}}}{2}\right) \times \frac{Q_{t_{n-1}} + Q_{t_n}}{2} \times p$$

where $M_{t_n}$ is the liquid water mass formed or evaporated from time $t_{n-1}$ to time $t_n$, where a positive number represents formation and a negative number represents evaporation, n is a natural number, $t_n = t_{n-1} + p$, p is a time step, natural number, $$H_{abs,atm_{t_{n-1}}}$$

is the value of the absolute humidity for atmospheric air determined at time $t_{n-1}$, $$H_{abs,atm_{t_n}}$$

is the value of the absolute humidity for atmospheric air determined at time $t_n$, $$H_{abs,comp_{t_{n-1}}}$$

is the value of the absolute humidity for compressed air determined at time $t_{n-1}$, considering 100% relative humidity for compressed air, $$H_{abs,comp_{t_n}}$$

is the value of the absolute humidity for compressed air determined at time $t_n$, considering 100% relative humidity for compressed air, $Q_{t_{n-1}}$ is the flow rate through the compressor determined at time $t_{n-1}$, and $Q_{t_n}$ is the flow rate through the compressor determined at time $t_n$.

7. The method of claim 6, wherein the cumulated liquid water mass at time $t_n$ is calculated using the formula:

$$M_{c,t_n} = M_{c,t_{n-1}} + M_{t_n}$$

where $M_{c,t_n}$ is the cumulated liquid water mass at time $t_n$, and $M_{c,t_{n-1}}$ is the cumulated liquid water mass at time $t_{n-1}$.

8. The method of claim 5, wherein the step of determining the flow rate comprises measuring the compressor speed and determining the flow rate based on the measured compressor speed.

9. The method of claim 1, wherein the step of determining the value $H_{abs,atm}$ of the absolute humidity for the atmospheric air entering the compressor comprises:

measuring the relative humidity of the atmospheric air with a humidity sensor, measuring the temperature of the atmospheric air with a first temperature sensor, and determining the value $H_{abs,atm}$ based on the measured relative humidity and measured temperature of the atmospheric air.

10. The method of claim 1, wherein the step of determining the value $H_{abs,comp}$ of the absolute humidity for the compressed air exiting the compressor comprises:

measuring the temperature of the atmospheric air with a first temperature sensor, determining the atmospheric pressure, such as by measuring the pressure of the atmospheric air with a first pressure sensor or estimating the pressure from the vehicle altitude or estimating the pressure to be 1.013 bar, determining the pressure of the compressed air, such as by measuring the pressure of the compressed air with a second pressure sensor or fixed parameter depending on system pressure, measuring the relative humidity of the atmospheric air with a humidity sensor, measuring the temperature of the compressed air with a second temperature sensor, and determining the value $H_{abs,comp}$ based on the measured temperature of the atmospheric air, the determined atmospheric pressure, the determined pressure of the compressed air, the measured relative humidity and measured temperature of the compressed air.

11. The method of claim 10, wherein the second temperature sensor is placed in the coldest area of the compressor.

12. The method of claim 1, wherein the steps of determining the value $H_{abs,atm}$ further comprises:

determining the vehicle's current altitude over sea level by means of a navigation system, determining the atmospheric air pressure based on the determined altitude, and determining the value $H_{abs,comp}$ based on the determined atmospheric air pressure.

13. The method of claim 1, further comprising:

using a compressor map to select, by means of the control unit, a compressor speed for which the temperature increase gradient relative to electric power consumption is optimized, and operating the compressor at the selected compressor speed.

14. A computer program comprising program code means for performing one or more of the steps of the method of claim 1 when the program is run on a computer.

15. A computer readable medium carrying a computer program comprising program code means for performing one or more of the steps of the method of claim 1 when the program code is run on a computer.

16. A control device for controlling an air compressor of a vehicle, the control device being configured to perform one or more of the steps of the method of claim 1.

17. A vehicle comprising the control device of claim 16.

* * * * *